United States Patent [19]

Abramson, Jr.

[11] Patent Number: 4,538,953

[45] Date of Patent: Sep. 3, 1985

[54] LOAD SECURING ASSEMBLY FOR A FORKLIFT TRUCK

[75] Inventor: Harold C. Abramson, Jr., Bay City, Mich.

[73] Assignee: The Dow Chemical Company, Midland, Mich.

[21] Appl. No.: 547,507

[22] Filed: Oct. 31, 1983

[51] Int. Cl.[3] ..... B66F 9/18

[52] U.S. Cl. ..... 414/608; 410/77; 414/622; 414/785

[58] Field of Search ..... 414/453, 454, 456, 608, 414/618, 619, 622, 785; 410/52, 69, 77

[56] References Cited

U.S. PATENT DOCUMENTS

| | | | |
|---|---|---|---|
| 2,675,139 | 4/1954 | Mercier et al. | 414/608 X |
| 2,740,542 | 4/1956 | Keem et al. | 414/454 |
| 3,126,223 | 3/1964 | Kughler | 414/622 X |
| 4,029,229 | 6/1977 | Hobson | 414/622 |
| 4,243,354 | 1/1981 | Garcia | 414/622 X |

FOREIGN PATENT DOCUMENTS

| | | | |
|---|---|---|---|
| 0846502 | 7/1981 | U.S.S.R. | 414/622 |

*Primary Examiner*—Robert J. Spar
*Assistant Examiner*—Ken Muncy
*Attorney, Agent, or Firm*—R. B. Ingraham

[57] ABSTRACT

A gravity operated load stabilizing device is provided for use with forklifts the device comprising an inverted J-shaped member which engages the load by gravity when the fork is raised and is disengaged from the load when the fork rests on a surface.

2 Claims, 5 Drawing Figures

LOAD SECURING ASSEMBLY FOR A FORKLIFT TRUCK

Oftentimes in the use of forklift trucks for the movement of a variety of containers and materials, it is desirable to stabilize the load to prevent accidental slippage of the load from the tines of the forklift. A variety of devices have been developed to prevent such an undesirable occurrence. Typical of such devices are those set forth in the following U.S. Pat. Nos. 3,477,601; 3,773,202; 3,797,687; 3,865,421; 4,116,349; 4,136,793; and 4,354,795; the teachings of which are herewith incorporated by reference thereto. Such load stabilizing devices effectively provide a more or less adjustable clamp which, in effect, squeezes the load between a clamping member and the tines of the forklift. Such arrangements are generally bulky, complex, expensive, and in some instances inconvenient.

It is an object of this invention to provide forklift stabilization with a minimum number of parts.

It is also an object of this invention to provide forklift load stabilization which does not require additional hydraulic or similar operating mechanism.

It is also an object of this invention to provide a forklift stabilizing mechanism which releases the load when the forklift is in the lower-most position.

These benefits and other advantages in accordance with the present invention are achieved in a forklift, the forklift being selectively positionable along a generally vertically extending mast, the forklift having a shank selectively positioned along said generally vertically extending mast, the forklift having affixed to the shank at least one generally horizontally extending dependent tine, said tine being disposed generally remote from said mast; a load engaging and disengaging means affixed to said shank with load engaging means adapted to engage a load on said fork lift when said fork lift is raised above a supporting surface, said load engaging means adapted to disengage said load when the said tine is disposed generally adjacent said supporting surface.

A particularly preferred embodiment of the present invention employs a member defining a generally vertically extending passageway affixed adjacent said shank, a latch member having a generally J-shaped configuration slideably disposed with the passageway, said J-shaped member having a generally linear shank slideably disposed in the passageway and a toe portion extending generally away from said mast; the J-shaped member being in an inverted position wherein said linear portion extends below the bottom of the tine when the fork is in the raised position, and when the fork is in a lowered position the toe of the J-shaped member being dispersed upwardly relative to said tine; the toe of said J-shaped member being adapted to engage a recess on a load when said fork assembly is in a raised position, and to disengage from a load to recess when the fork is in a lowered position.

Further features and advantages of the present invention will become more apparent from the drawings wherein FIG. 1 is a schematic side view of a forklift truck in accordance with the present invention;

Figure 1:
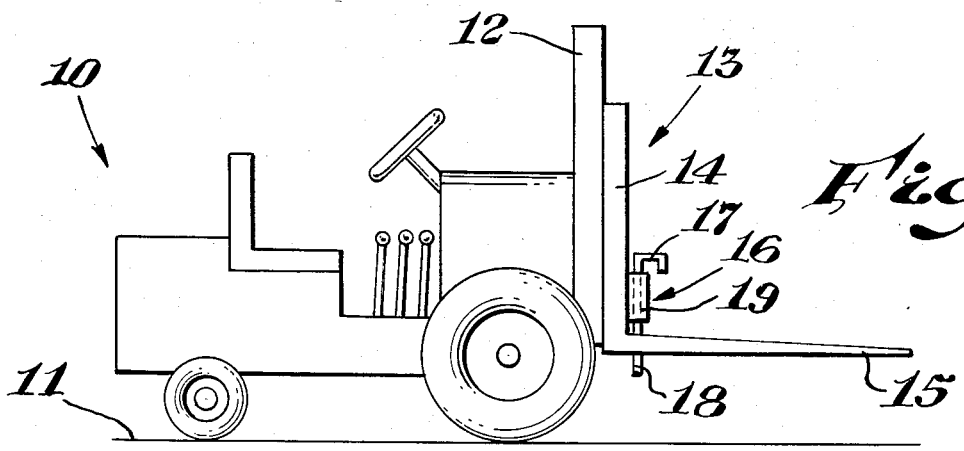

In FIG. 1 there is schematically depicted a side view of a forklift truck generally designated by the reference numeral 10. The forklift truck is in an upright operating position and rests on a surface 11. The forklift truck 10 has a mast 12 which is generally vertically extending, and a fork assembly 13 which is movable upwardly and downwardly on the mast 12 by means not shown. The fork assembly 13 comprises a shank 14 having affixed thereto two tines 15, one shown. The tines 15 are affixed to the lowermost portion of the shank 14 and extend generally horizontally away from the mast 12. Adjacent the juncture of the tine 15 and shank 14 is a latching assembly generally designated by the reference numeral 16. The latching assembly 16 comprises a generally J-shaped member 17 having the hook portion of the J upwardly disposed and the elongate leg of the J 18 extending downwardly to a distance below tine 15. The elongate leg of the J is slideably disposed within a housing 19 which is maintained in a fixed position relative to the shank 14 and the tine 15.

Figure 2:
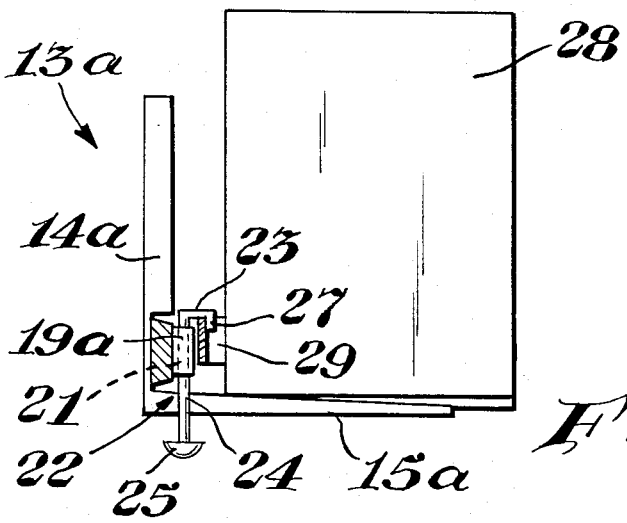
FIG. 2 is a fractional partially cutaway view of a load stabilizing assembly in accordance with the present invention.

In FIG. 2 there is depicted a fractional sectional view of a fork **13*a* having a shank portion 14*a* and a tine 15*a* affixed to the lower portion of the generally vertically extending shank 14*a*. A hollow housing 19*a* is affixed to the fork assembly 13*a* and defines a vertically extending passageway 21. Disposed partially within the vertical passageway 21 is a generally J-shaped member 22 having a generally curved foot portion 23. The J-shaped member 22 is of inverted configuration wherein the generally curved foot portion 23 is upwardly disposed and a straight leg 24 of the J passes within the passageway 21. The straight leg 24 of the member 22 terminates in a surface engaging pad 25. The curved foot 23 of the member 22 terminates in a load engaging projection 27 which is generally parallel to the leg 24 and is downwardly projecting. A load 28 is supported on the tine 15*a* and a recess forming means 29 is affixed to the load 28 and is engaged by the projection 27. The J-shaped member 22 is sized such that when the fork 13*a* is lowered to a surface, pad 25 engages the surface forcing J-shaped member 22 upward and out of engagement with the recess 29, thus permitting the tines 15*a* to be withdrawn. When the tines 15*a* are positioned under the load of the projection 27 over the recess 29, raising of the tines and the load causes the projection 27 to engage the recess 29** and stabilize the load.

Figure 3:
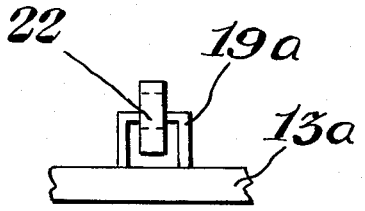
FIG. 3 is a top fractional view of the load engaging and stabilizing assembly of FIG. 2.

FIG. 3 is a fractional top view of a load engaging member 22 slideably supported in a housing **19*a* and affixed to a portion of a fork assembly 13*b***.

Figure 4:
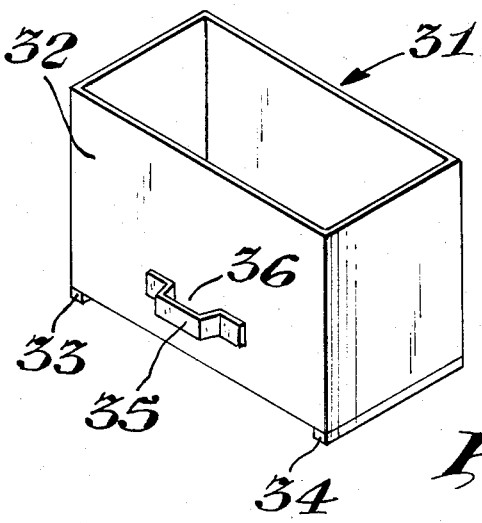
FIG. 4 is a schematic representation of a bin or container suitable for use in the present invention.

FIG. 4 depicts one variety of container suitable for use in the present invention generally designated by the reference numeral 31. The container 31 comprises a generally rectangular container 32 having a bottom not shown. A pair of generally parallel skid members 33 and 34 are affixed to the bottom thereof. A generally U-shaped striplike member 35 is affixed to the container 31 generally adjacent the skids 33 and 34 to define a latch-receiving recess 36.

Figure 5:
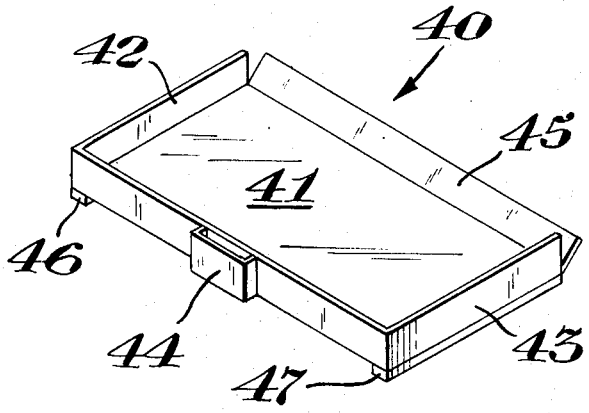
FIG. 5 depicts an alternate pallet-like container suitable for use with the present invention.

FIG. 5 depicts a shallow pallet 40 having a bottom 41, first fixed side 42, second fixed side 43 and a latch engaging recess defining means 44. Remote from the latch receiving means 44 is a selectively positionable lockable side 45 which optionally may be positioned parallel to the bottom 41 or positioned vertically to engage sides 42 and 43. Skid members 46 and 47 are parallel to sides 42 and 43 respectively.

In operation of the forklift device in accordance with the present invention, a container such as container 31 or 40 is approached by the forklift truck with the tines adjacent the supported surfaces such as the surface 11 and the tines slide over the load. With the tines approaching a surface such as the surface 11, the latching member such as the member 17 or 22 or 22*a* is raised above the level of a recess forming means such as the recess 29 of FIG. 2, the recess means 35 of FIG. 4, or the recess means 44 of FIG. 5. On raising of the forklift assembly, the generally J-shaped retaining member remote from the surface engaging portion such as portion 25 of FIG. 2 by gravity falls below the level of the tines permitting the toe of the J-shaped member such as 27 of the member 22 to be inserted into the recess and preventing any significant relative motion of the load.

Forklift assemblies in accordance with the present invention may be prepared in a variety of manners. The FIGS. 1–5 are purely schematic in nature and intended to demonstrate as simply as possible the principle of operation of the present invention. For most purposes one latching member such as the J-shaped member 22 of FIG. 2 is adequate; however, two or more may also be employed. The position of the J-shaped member must be generally vertical and however, for some applications, may be positioned in such a manner that a container such as container 31 could rest against the shank members 14 of the fork of FIG. 1, depending on whether an existing forklift is modified to employ the inventions or a forklift and container are designed specifically to use the invention.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A forklift, the forklift being selectively positionable along a generally vertically extending mast, the forklift having a shank selectively positioned along said generally vertically extending mast, the forklift having affixed to the shank at least one generally horizontally extending dependent tine, said tine being disposed generally remote from said mast; a load engaging and disengaging means affixed to said shank with load engaging means adapted to engage a load on said forklift when said forklift is raised above a supporting surface, said load engaging means adapted to disengage said load when the said tine is disposed generally adjacent said supporting surface, including a member defining a generally vertically extending passageway affixed adjacent said shank, the load engaging means having a generally J-shaped configuration, the load engaging means slideably disposed with the inset passageway, said load engaging means having a generally linear shank slideably disposed in the passageway and a toe portion extending generally away from said mast; the load engaging means being in an inverted position wherein said linear shank extends below the bottom of the tine when the tine is in a raised position; and when the tine is in a lowered position, the toe of the load engaging means being disposed upwardly relative to said tine; the toe of said load engaging means being adapted to engage a recess on a load when said tine assembly is in a raised position and disengage from the recess on a load when the tine is in a lowered position.

2. The forklift of claim 1 including a supporting surface engaging pad affixed to the load engaging means at a location below the bottom of the tine when the tine is in the raised position.

* * * * *